US007243863B2

(12) United States Patent
Glunk

(10) Patent No.: US 7,243,863 B2
(45) Date of Patent: Jul. 17, 2007

(54) SHOWER HEAD

(75) Inventor: Guenter Glunk, Fluorn-Winzeln (DE)

(73) Assignee: Hansgrohe AG, Schiltach (DE)

( * ) Notice: Subject to any disclaimer, the term of this patent is extended or adjusted under 35 U.S.C. 154(b) by 134 days.

(21) Appl. No.: 10/467,996

(22) PCT Filed: Feb. 15, 2002

(86) PCT No.: PCT/EP02/01604

§ 371 (c)(1),
(2), (4) Date: Mar. 31, 2004

(87) PCT Pub. No.: WO02/066169

PCT Pub. Date: Aug. 29, 2002

(65) Prior Publication Data

US 2004/0164184 A1 Aug. 26, 2004

(30) Foreign Application Priority Data

Feb. 21, 2001 (DE) ..... 101 08 248

(51) Int. Cl.

| | |
|---|---|
| ***B05B 7/08*** | (2006.01) |
| ***B05B 1/14*** | (2006.01) |
| ***B05B 7/14*** | (2006.01) |
| ***A62C 2/08*** | (2006.01) |

(52) U.S. Cl. ..... 239/549; 239/548; 239/553; 239/443; 239/445; 239/436; 239/437; 239/438

(58) Field of Classification Search ..... 239/549, 239/548, 553, 443, 445, 436, 437, 438
See application file for complete search history.

(56) References Cited

U.S. PATENT DOCUMENTS

| | | | | |
|---|---|---|---|---|
| 3,876,151 | A * | 4/1975 | Katva | 239/437 |
| 3,998,390 | A * | 12/1976 | Peterson et al. | 239/394 |
| 4,497,444 | A | 2/1985 | Arnold | |
| 5,213,267 | A * | 5/1993 | Heimann et al. | 239/446 |
| 5,398,872 | A * | 3/1995 | Joubran | 239/99 |
| 5,697,557 | A * | 12/1997 | Blessing et al. | 239/447 |

OTHER PUBLICATIONS

PCT International Preliminary Examination Report.

* cited by examiner

*Primary Examiner*—Davis Hwu
(74) *Attorney, Agent, or Firm*—Duane Morris LLP

(57) ABSTRACT

The invention relates to a shower head containing a cup-like housing (1) that, in particular, is injection molded out of plastic. The cup bottom has an opening (3) for placing a connection element (4) therethrough. A spray disk element (7) is to the housing and can be joined to said housing (1) by means of a simple plugging-in, snapping-in or turning. The shower head is comprised of two parts and, optionally, of a separate seal (8, 15, 20).

18 Claims, 4 Drawing Sheets

SHOWER HEAD

Figure 1:
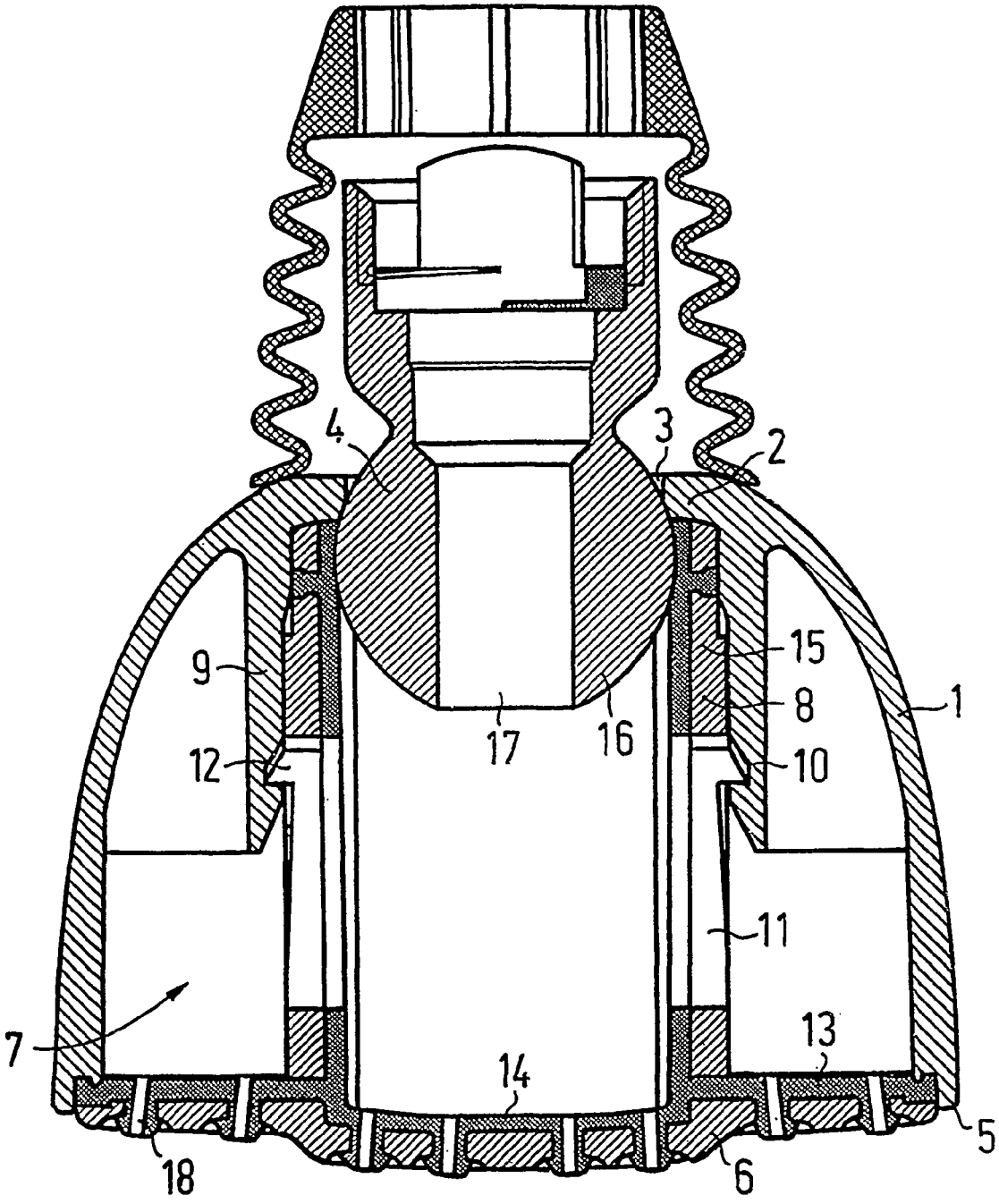

The invention relates to a shower head, in particular, a shower head that is attached to a fitting such that it is pivotable.

A pivotable shower head configured from a few parts is already known (cf. U.S. Pat. No. 4,497,444). A seal serves to both seal the joint and brake pivoting of the housing of the shower head. However, that shower head contains no sprayer disk.

The problem addressed by the invention is creating a shower head that is as simply constructed as possible, inexpensive to manufacture, and consists of as few parts as possible.

In order to solve that problem, the invention proposes a shower head having those features stated in claim 1. Elaborations on the invention are covered by the subclaims.

In the simplest case, the shower head proposed by the invention consists of two parts, namely, a housing and a sprayer-disk element, along with a seal.

Under an elaboration on the invention, it may be provided that the housing is cup-shaped, where the opening for inserting a connecting element is arranged in the vicinity of the base of the cup, in which case, it may be provided that the sprayer disk covers the opening in the cup.

Under a further elaboration on the invention, the connection between the sprayer-disk element and the housing may be arranged in the vicinity of the opening for the connecting element.

According to the invention, it may be provided that the device for connecting the housing and the sprayer disk is a snap-on connector. In assembling the housing, all that needs to be done is insert the connecting element through the opening for the connecting element and insert the sprayer-disk element into the housing. The latter will then automatically snap into place in the connector at the right location thereon.

It will also be feasible to provide that the joining device has a bayonet fitting or a threaded fitting requiring no screws.

The seal may be a simple, mass-produced, O-ring seal that is available at low cost.

It will also be feasible, and is covered under the invention, if the seal has a large surface area, i.e., is, for example, a sleeve.

Under an elaboration on the invention, it may be provided that the sprayer-disk element has a roughly cylindrical extension on its inner surface, to whose outer edge the sprayer disk is attached. In particular, that extension, together with the sprayer-disk element, may be configured in the form of a single, monolithic unit.

Under an elaboration on the invention, it may be provided that the cylindrical extension of the sprayer-disk element interacts with a cylindrical extension on the inner surface of the housing, where it may be provided that the joining device acts between the two cylindrical extensions.

Under an elaboration on the invention, in order to arrive at a particularly favorable design, it may be provided that the seal for the connecting element and the seal for the edge of the sprayer disk are fabricated, in particular, are injection molded, as a single, monolithic unit.

In particular, it may be provided that the seal for the sprayer disk is part of an elastomer disk abutting against the inner surface of the sprayer disk, facing the openings from which jets of water exit.

The invention proposes that the seal that seals the edge of the sprayer disk to the housing be loaded in compression along a direction normal to the plane of the openings in the housing from which jets of water exit.

In order to allow a tight sealing between the edge of the sprayer disk and the housing in the case of a housing for which the cylindrical extension extends far into the as well, in accordance with the invention, the sprayer disk may be inherently "springy," which may, for example, be achieved by providing that the sprayer disk has a section that is thinner than the remainder thereof.

According to the invention, the joining device may be arranged closer to the opening for the connecting element than to the opening on the opposite end from which water exits, when viewed along the longitudinal axis of the housing of the shower head.

Under an elaboration on the invention, it may be provided that the connecting element has a roughly spherical end section that engages the housing and is pivotable with respect to the housing. The housing may thus be pivoted about the connecting element, which is attached to the end of a line, where, in particular, it may be provided that the seal will simultaneously also allow setting the former to a certain angle.

Figure 2:
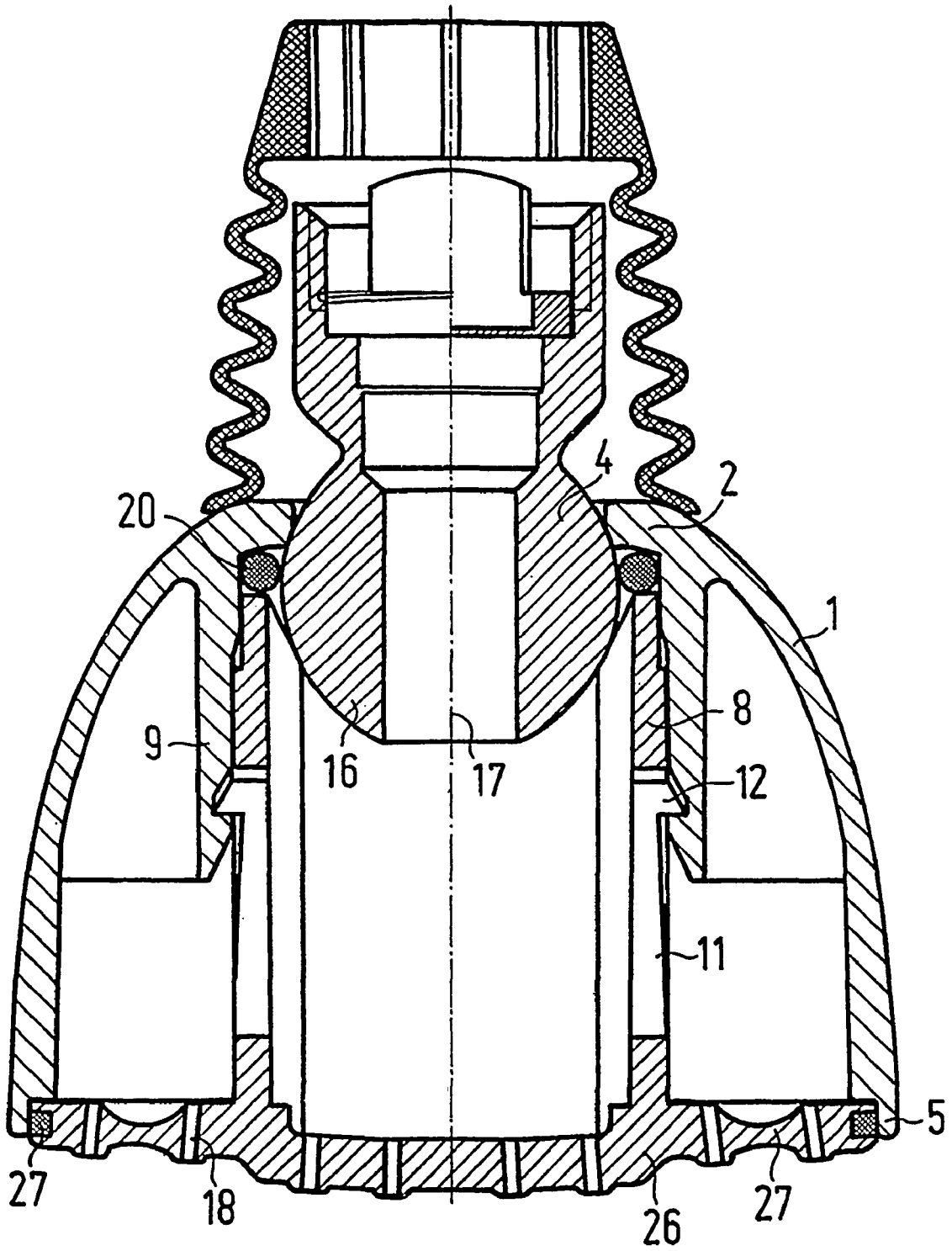
Figure 3:
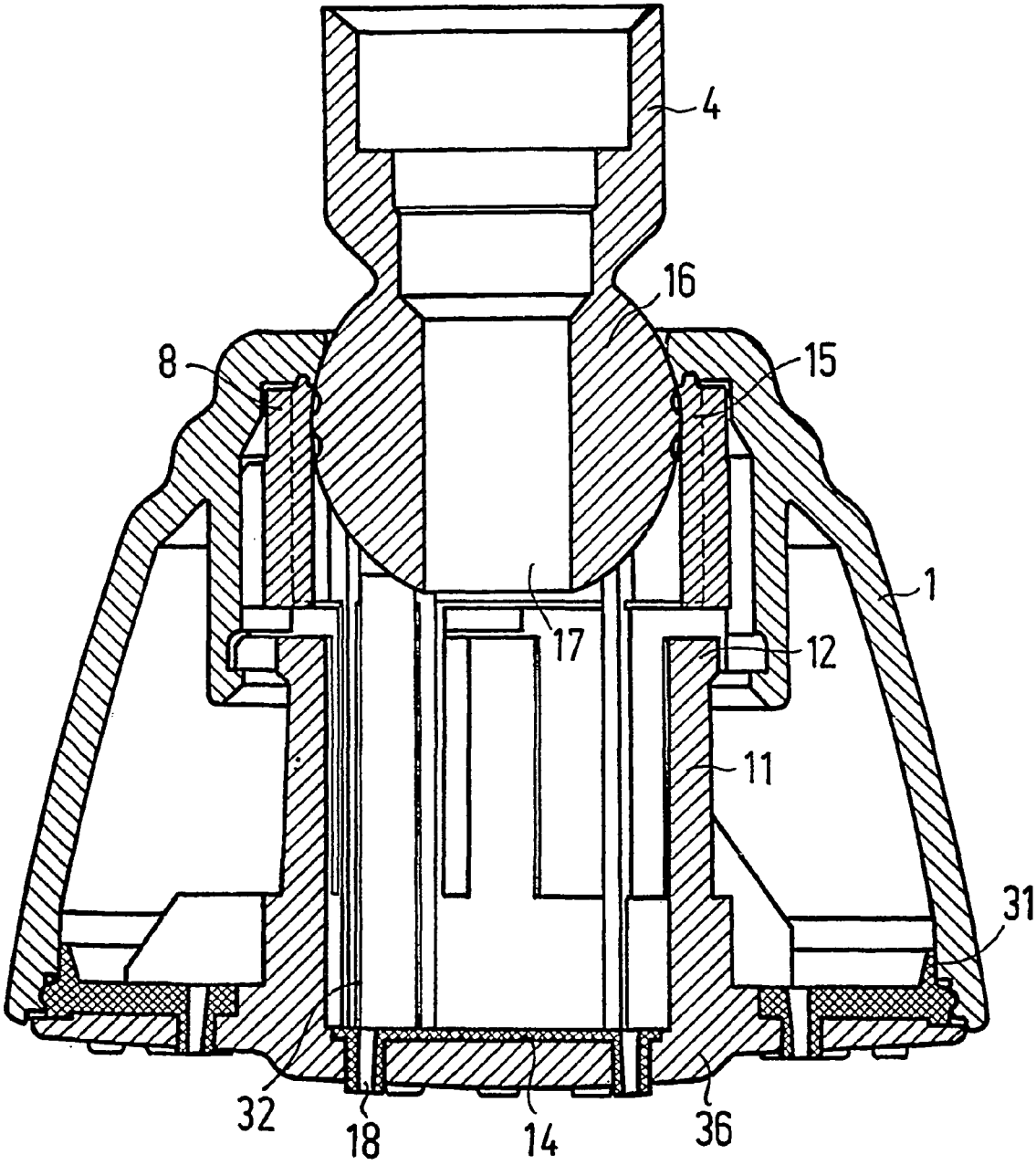

Other features, details, and benefits will be evident from the following descriptions of preferred embodiments of the invention and the drawings, which depict:

FIG. 1 a longitudinal section through a first embodiment of a shower head;

FIG. 2 a longitudinal section, corresponding to that of FIG. 1, through a second embodiment of the shower head according to the invention;

FIG. 3 a longitudinal section through a third embodiment; and

Figure 4:
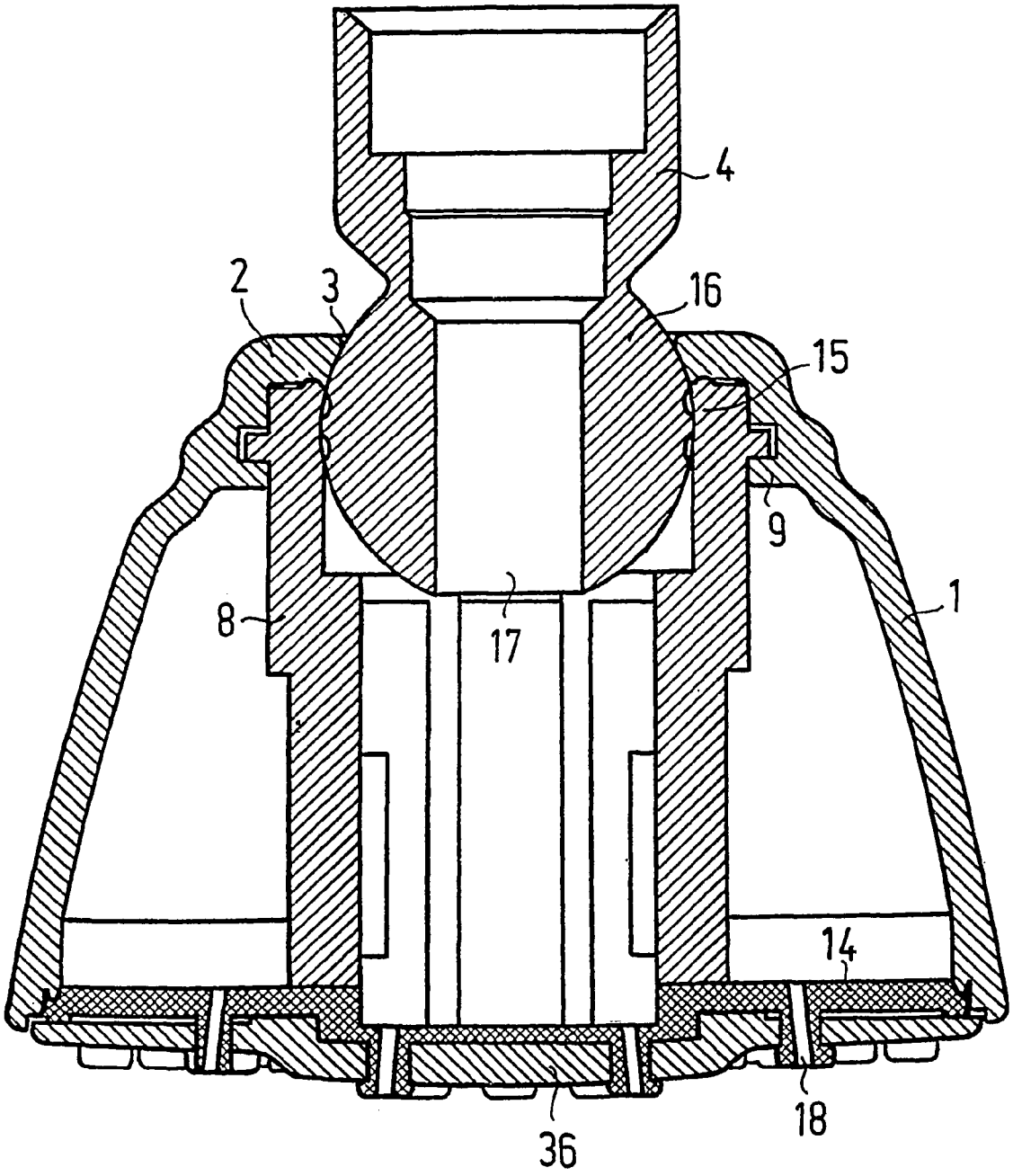

FIG. 4 a longitudinal section through a fourth embodiment.

FIG. 1 depicts a longitudinal section through a shower head according to the invention. The shower head comprises a housing 1 in the form of a cup. An opening 3, through which the connecting element 4 extends, is formed in the base 2 of the cup. The opposite end of the cup-shaped housing 1, i.e., the bottom end thereof in FIG. 1, forms an opening that is bounded by the rim 5 of the housing 1. That opening is covered by a sprayer disk 6 that is part of a sprayer-disk element 7. A concentric, roughly cylindrical, extension 8 that faces the inner surface of the sprayer disk 6 is formed on the inner surface of the housing 1. That cylindrical extension 8 engages the inner surface of another cylindrical extension 9 that is formed on the inner surface of the housing 1 of the shower head such that there is no play between the two extensions. The cylindrical extension 9 correlated to the housing 1 extends concentrically from the base 2 of the cup to the opening 3 therein, and extends over roughly half of the length of the housing 1. A V-shaped groove 10 extends over at least part of the circumference of the inner surface of the cylindrical extension 9.

The cylindrical extension 8 on the inner surface of the sprayer disk 6 has several "snap"-type latching elements 11 that have a protrusion 12 on their outer surface, each of which is arranged in a through hole, distributed around its circumference. Those latching protrusions 12 engage the circumferential, V-shaped groove 10 when the sprayer-disk element in inserted into the housing 1.

A seal 13 that is configured in the form of an elastomer disk 14 and abuts against the inner surface of the sprayer disk 6 is provided for sealing the edge of the sprayer disk 6 to the rim 5 of the housing 1. That seal 13 is loaded in compression in the longitudinal direction in the vicinity of the zone where the edge of the sprayer disk 6 contacts the housing, where "the longitudinal direction" is that extending from the base 2 of the housing to the opening in its opposite end where jets of water exit.

The seal 13 in the form of an elastomer disk 14 continues along the inner surface of the cylindrical extension 8 of the sprayer-disk element 7, all the way out to the free end of the cylindrical extension 8. Its elastomeric material grips the housing through openings near the end of the cylindrical extension 8 that extend radially outward, and seals the housing with respect to leakage to the ambient. A seal 15, against which the end of the connecting element 4 abuts over a large area, is thus formed on the inner surface of the cylindrical extension 8. That seal 15 is pressed against the connecting element 4, in the vicinity of its end, by the cylindrical extension 8 of the sprayer-disk element 7, with the assistance of the pressure exerted by the cylindrical extension 9 of the housing 1.

In the case of the example shown, the connecting element 4 has a roughly spherical end section 16 arranged in the interior of the housing 1. The abutment of the seal 15 against the outer surface of its spherical end section 16 under pressure yields a braking effect in order that the housing 1 will be arrested at a preset position. However, the housing 1 may be pivoted with respect to the end section 16. The end section 16 has a through hole 17 for water to pass through. The section of the connecting element 4 that protrudes from the housing 1 is configured such that it may be screwed onto a water pipe or a hose fitting.

The elastomer disk 14 forming the seal 13 is also molded on the sprayer disk 6 such that portions thereof extend through openings in the latter, where those portions thereof that are molded thereon such that they extend through the latter form the openings through which jets of water exit.

The shower head is assembled as follows: The connecting element 4 is initially inserted into the housing 1 from the latter's open end with its upper end section, i.e., its top end, as shown in FIG. 1, facing upward until its roughly spherical end section 16 abuts against the edges of the through holes 3. The sprayer-disk element is then inserted into the housing 1 from the latter's open end until the protrusions 12 on its latching elements 11 snap into the groove 10. In this condition, the zone extending around the outer edge of the seal 13 will be compressed such that sealing will be effected throughout that zone. A sealing of the former's upper end will also be effected by the upper section 15 of the seal. Tolerances that may arise during manufacture of the housing and/or sprayer-disk element 7 will be taken up, or compensated for, by plastic deformations occurring in the vicinity of the edge of the seal 13.

FIG. 2 depicts a slightly modified embodiment. The joint between the sprayer-disk element 7 and the housing 1 is similarly configured, namely, the former is held in place in the latter by latching elements 11 that have protrusions 12 in the vicinity of the end of their outer surface. The necessary resilient protrusions may also be formed on the housing.

An O-ring 20 that is held in place between the base 2 of the cup and the upper edge of the cylindrical extension 8 on the inner surface of the sprayer-disk element is provided for sealing the joint between the housing 1 and the connecting element 4. That O-ring 20 is also compressed by the upper edge of the cylindrical extension 8 in order that it will, in a similar manner, effect both a sealing and a braking of the housing 1 with respect to the end section of the connecting element 4.

In the case of this particular embodiment, a seal 27 arranged in a radially open groove serves to seal the sprayer disk 26 to the rim 5 of the housing. The sprayer-disk element 26 is configured such that it has a section 27 that is thinner than the remainder thereof in order to take up manufacturing tolerances. In this case as well, the zone extending around the edge of the disk 26 from which jets of water exit will also be pressed against the housing 1.

FIG. 3 depicts yet another embodiment where, as in the case of the embodiment shown in FIG. 1, the sprayer disk 36 is configured from a hard component, onto which an elastomer disk 14 has been molded. Once again, this elastomer disk 14 incorporates portions that extend through openings in the sprayer disk 36 that form the openings 18 through which jets of water exit. The zone extending around the edge of the elastomer disk 14 is loaded in compression in order to take up manufacturing tolerances. The elastomer disk 14, also has a circumferential sealing lip 31 molded onto its inner surface, i.e., that facing the interior of the housing 1, near its edge that also serves to compensate for axial-tolerance mismatches.

The upper section 15 of the seal that seals the joint between the cylindrical extension 8 of the sprayer-disk element and the end section 16 of the connecting element 4 is joined to the elastomer disk 14 by a channel 32 molded onto the outer surface of the cylindrical extension 8 of the sprayer-disk element. Once again, the cylindrical extension 8 is axially located by latching elements 11 having protrusions 12 that engage circumferential grooves in the spherical surface of the connecting element 4.

FIG. 4 depicts an embodiment similar to that shown in FIG. 3. However, in this case, a bayonet fitting that acts on a zone near the end of the cylindrical extension 8 of the sprayer-disk element and latches it to the inner surface of the housing 1 joins the disk 36 from which jets of water exit, or the sprayer-disk element, to the housing 1. Otherwise, this embodiment is configured similarly to that shown in FIG. 3, and thus will not be described in detail here. In this case as well, assembly of the shower head is a simple matter, since all that is required is inserting the sprayer-disk element into the extension 9 and then rotating it in order to bring the bayonet fitting to its latched position.

What is claimed is:

1. A shower head comprising:

a connecting element by which the shower head is connectable to a water supply, a housing that has an opening receiving the connecting element and an exit opening opposite the connecting element toward a direction of water jet exit, a sprayer-disk element that has a sprayer disk that covers the exit opening and seals around a rim of the housing, and wherein the sprayer-disk element has a joint that attaches at an inner surface of the housing, wherein a seal for sealing between the inner surface of the housing and the connecting element is pressed against the connecting element by the sprayer-disk element in a position where the sprayer disk seals around the rim of the housing, wherein the sprayer-disk element has a roughly cylindrical extension on whose outer end is located the sprayer disk, and, wherein the cylindrical extension of the sprayer-disk element abuts against a cylindrical extension of the inner surface of the housing.

2. A shower head according to claim 1, wherein the joint at which the sprayer-disk element attaches to the inner surface of the housing acts between the cylindrical extensions of the sprayer-disk element and the inner surface of the housing.

3. A shower head comprising:

a housing that has an opening for inserting a connecting element and an exit opening opposite the connecting element, a sprayer-disk element that has a sprayer disk sealed to a rim of the housing that covers the exit opening and may be joined to an inner surface of the housing, a seal for sealing the inner surface of the housing to the connecting element that is pressed against the connecting element by the sprayer-disk element, wherein a seal for sealing the sprayer disk is part of an elastomer disk bearing the openings from which jets of water exit that abuts against the inner surface of the sprayer disk.

4. A shower head according to claim 3, wherein the housing is shaped as a cup, and wherein the opening for the connecting element is arranged in a vicinity of a base of the cup.

5. A shower head according to claim 3, wherein the joint at which the sprayer-disk element attaches to the inner surface of the housing is in a vicinity of the opening for receiving the connecting element.

6. A shower head according to claim 3, having a joining device comprising a bayonet fitting.

7. A shower head according to claim 3, wherein the joint at which the sprayer-disk element attaches to the inner surface of the housing comprises a threaded fitting.

8. A shower head according to claim 3, wherein the seal comprises an O-ring.

9. A shower head according to claim 3, wherein the seal has a large surface area.

10. A shower head according to claim 3, wherein the sprayer-disk element has a roughly cylindrical extension on whose outer end is located the sprayer disk.

11. A shower head according to claim 3, wherein the seal for sealing the connecting element and a seal for sealing the edge of the sprayer disk are molded into a single, monolithic unit.

12. A shower head according to claim 3, wherein the sprayer disk is configured such that it is at least one of resilient and flexible, along a direction normal to its plane.

13. A shower head according to claim 3, wherein the sprayer disk has a section that is thinner than a remainder of the sprayer disk extending around a zone near its edge.

14. A shower head according to claim 3, wherein the joint at which the sprayer-disk element attaches to the inner surface of the housing is closer to the opening for the connecting element than to the opening in the housing from which water exits, when viewed along a longitudinal direction.

15. A shower head according to claim 3, wherein the connecting element has a roughly spherical end section that engages the housing, is pivotable with respect to the housing, and is braked and detented by the seal for sealing between the inner surface of the housing and the connecting element.

16. A shower head according to claim 3, wherein at least one of the housing and sprayer-disk element comprises a single monolithic unit injection molded from plastic.

17. A shower head according to claim 3, wherein the sprayer-disk element and an elastomer are injection molded employing a two-component process such that the elastomer seals the sprayer-disk element with at least one of the connecting element and the rim of the housing.

18. A shower head comprising:

a connecting element by which the shower head is connectable to a water supply, a housing that has an opening receiving the connecting element and an exit opening opposite the connecting element toward a direction of water jet exit, a sprayer-disk element that has a sprayer disk that covers the exit opening and seals around a rim of the housing, and wherein the sprayer-disk element has a joint that attaches at an inner surface of the housing, wherein a seal for sealing between the inner surface of the housing and the connecting element is pressed against the connecting element by the sprayer-disk element in a position where the sprayer disk seals around the rim of the housing, and, wherein a seal for sealing the sprayer disk is loaded in compression along a direction normal to a plane of the opening in the housing from which jets of water exit, by attachment of the sprayer-disk element to the housing at the joint at which the sprayer-disk element attaches to the inner surface of the housing.

* * * * *